US012225951B2

(12) United States Patent
Dingemanse et al.

(10) Patent No.: US 12,225,951 B2
(45) Date of Patent: Feb. 18, 2025

(54) UPPER BODY TRAVEL GARMENTS WITH INTEGRAL COMFORT FEATURES

(71) Applicant: EMBRAER S.A., São José dos Campos - SP (BR)

(72) Inventors: Donald Jesse Dingemanse, São José dos Campos - SP (BR); Elsemiek Aten, São José dos Campos - SP (BR); Luciana Ribeiro Monteiro, São José dos Campos - SP (BR); Nathalie Sheila Vis, São José dos Campos - SP (BR); Tianchen Liu, São José dos Campos - SP (BR); Tünde Szakács, São José dos Campos - SP (BR)

(73) Assignee: EMBRAER S.A., São José Dos Campos - SP (BR)

( * ) Notice: Subject to any disclaimer, the term of this patent is extended or adjusted under 35 U.S.C. 154(b) by 468 days.

(21) Appl. No.: 17/614,789

(22) PCT Filed: Jun. 19, 2019

(86) PCT No.: PCT/BR2019/000020
§ 371 (c)(1),
(2) Date: Nov. 29, 2021

(87) PCT Pub. No.: WO2020/252542
PCT Pub. Date: Dec. 24, 2020

(65) Prior Publication Data

US 2022/0225695 A1 Jul. 21, 2022

(51) Int. Cl.
*A41D 1/02* (2006.01)
*A41D 1/04* (2006.01)
(Continued)

(52) U.S. Cl.
CPC ..... *A41D 13/0051* (2013.01); *A41D 1/02* (2013.01); *A41D 1/04* (2013.01); *A41D 15/04* (2013.01)

(58) Field of Classification Search
CPC ..... A41D 13/0051; A41D 1/02; A41D 1/04; A41D 15/00; A41D 15/002; A41D 15/04
See application file for complete search history.

(56) References Cited

U.S. PATENT DOCUMENTS 5,040,243 A * 8/1991 Tatsuno ..... A41D 15/00 2/87
5,115,516 A * 5/1992 Golde ..... A41D 23/00 2/84

(Continued)

OTHER PUBLICATIONS

International Search Report for PCT/BR2019/000020, dated Feb. 25, 2020, 4 pages.

(Continued)

*Primary Examiner* — Jameson D Collier
(74) *Attorney, Agent, or Firm* — NIXON & VANDERHYE P.C.

(57) ABSTRACT

Upper body garments (10) (e.g., jackets, vests or the like) are provided having front (12) and back panels enclosing a torso region of a wearer. The back panel includes a cushion back panel (14) having an upper end attached to the front panel (12) at shoulder regions of the garment (10) and extending from the upper end thereof to a lower end positioned at or below a waist region of the wearer. A pull cord (50, 52) has one end operably connected to the lower end of the cushion back panel (14) and an opposite free end positioned near one of the shoulder regions of the garment (10) such that a pull force exerted on the latter when the cushion back panel (14) is in an unattached configuration causes the cushion back panel (14) to roll onto itself from the lower end thereof
(Continued)

toward the upper end thereof and thereby form a cushion roll (60) at a neck region of the wearer.

23 Claims, 9 Drawing Sheets

(51) Int. Cl.
*A41D 13/005* (2006.01)
*A41D 15/04* (2006.01)

(56) References Cited

U.S. PATENT DOCUMENTS

| | | | | |
|---|---|---|---|---|
| 7,412,728 | B2 * | 8/2008 | Alesina | A41D 27/28 2/93 |
| 2011/0088135 | A1 | 4/2011 | Snyder et al. | |
| 2013/0152270 | A1 | 6/2013 | Neal et al. | |
| 2013/0219624 | A1 * | 8/2013 | Soffer | A45C 9/00 5/636 |
| 2014/0345029 | A1 * | 11/2014 | Saladino | A41D 15/002 2/84 |
| 2015/0223527 | A1 * | 8/2015 | Arora | A41D 13/0125 2/86 |
| 2017/0224033 | A1 | 8/2017 | Latta, Jr. | |
| 2017/0258154 | A1 * | 9/2017 | Peyser | A45F 3/00 |

OTHER PUBLICATIONS

Written Opinion of the ISA for PCT/BR2019/000020, dated Feb. 25, 2020, 5 pages.

* cited by examiner

UPPER BODY TRAVEL GARMENTS WITH INTEGRAL COMFORT FEATURES

This application is the U.S. national phase of International Application No. PCT/BR2019/000020 filed 19 Jun. 2019, which designated the U.S., the entire contents of which is hereby incorporated by reference.

FIELD

The embodiments disclosed herein relate generally to upper body travel garments, e.g., jackets, vests and the like that are especially adapted to provide comfort to passengers during travel, especially long distance aircraft flights.

BACKGROUND

The extended hours of long distance travels can present several challenges to a passenger in terms of comfort. For example, a passenger is typically seated for prolonged periods during long distance travel and thus must adapt such a seated posture to the typical passenger activities during travel, including sleeping, reading and/or watching videos on a seat-back screen or a personal electronic device. Needless to say, such prolonged seated posture can contribute to passenger discomfort.

Cabin environmental conditions can also contribute to discomfort during prolonged travel. For example, the interior cabin temperature which houses passengers during such long distance travel typically be quite cool to many individual passengers that will in turn require the carrier to provide blankets to the passengers for warmth.

It would therefore be desirable if a travel garment could be provided which will allow passengers to adjust to individual preferences so as to achieve enhanced comfort, especially during long haul travel excursions. It is towards fulfilling such a need that the embodiments disclosed herein are directed.

BRIEF DESCRIPTION

Broadly, the embodiments disclosed herein are directed toward a travel jacket that integrally includes features to enhance passenger comfort. In certain embodiments, the travel jacket disclosed herein may be provided with an integral neck pillow assembly to accommodate various seated posture variations while other embodiments may additionally or alternatively be provided with integral temperature controls to allow the passenger to select an individual temperature condition that is comfortable.

According to certain embodiments an upper body garment (e.g., jacket, vest or the like) is provided having front and back panels enclosing a torso region of a wearer. The back panel includes a cushion back panel having an upper end attached to the front panel at shoulder regions of the garment and extending from the upper end thereof to a lower end positioned at or below a waist region of the wearer. A pull cord assembly is provided with a pull cord having one end operably connected to the lower end of the cushion back panel and an opposite free end positioned near one of the shoulder regions of the garment. Important to such embodiments, the right and left sides of the cushion back panel are releasably attachable (e.g., via any conventional two-part fabric attachments such as zippers, snaps, buttons/buttonholes, hook and loop fasteners and the like) to corresponding right and left sides of the front panel thereby allowing the cushion back panel to assume attached and unattached configurations relative to the front panel. In such a manner, therefore, a pull force exerted on the free end of the pull cord when the cushion back panel is in the unattached configuration causes the cushion back panel to roll onto itself from the lower end thereof toward the upper end thereof and thereby form a cushion roll at a neck region of the wearer.

The cushion back panel may comprise a series of eyelets between the upper and lower ends thereof for receiving the pull cord therein. A releasable shoulder patch may be provided so as to cover the terminal free end of the pull cord at the shoulder region of the wearer.

The front panel may be provided with several conveniences, such as at least one hand pocket and/or at least one breast pocket. In order to promote wearer comfort, a warming system may be operably associated with, e.g., the hand pocket(s) so as to serve as a hand warmer.

Some embodiments of the garment may include draw string at the waist region of the wearer to allow waist dimension adjustment thereof.

The cushion back panel may include a series of substantially horizontally disposed channel sections. For example, certain embodiments of the cushion back panel include a right and left series of substantially horizontally disposed channel sections, and a central non-channel section disposed between the right and left series of channel sections. In such embodiments, at least one of the right and left series of channel sections may comprise the series of eyelets between the upper and lower ends thereof for receiving the pull cord therein as briefly mentioned above.

These and other aspects and advantages of the present invention will become more clear after careful consideration is given to the following detailed description of the preferred exemplary embodiments thereof.

BRIEF DESCRIPTION OF ACCOMPANYING DRAWINGS

The disclosed embodiments of the present invention will be better and more completely understood by referring to the following detailed description of exemplary non-limiting illustrative embodiments in conjunction with the drawings of which:

Figure 5A:
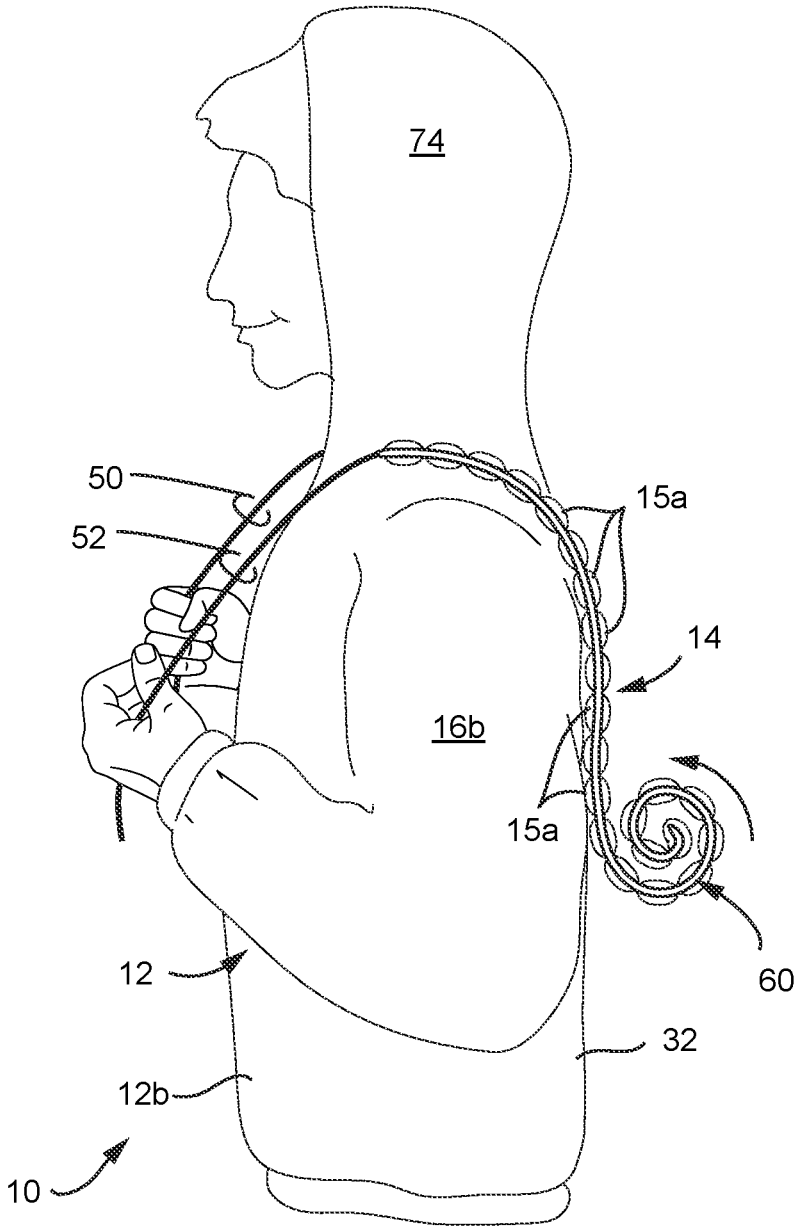
Figure 5B:
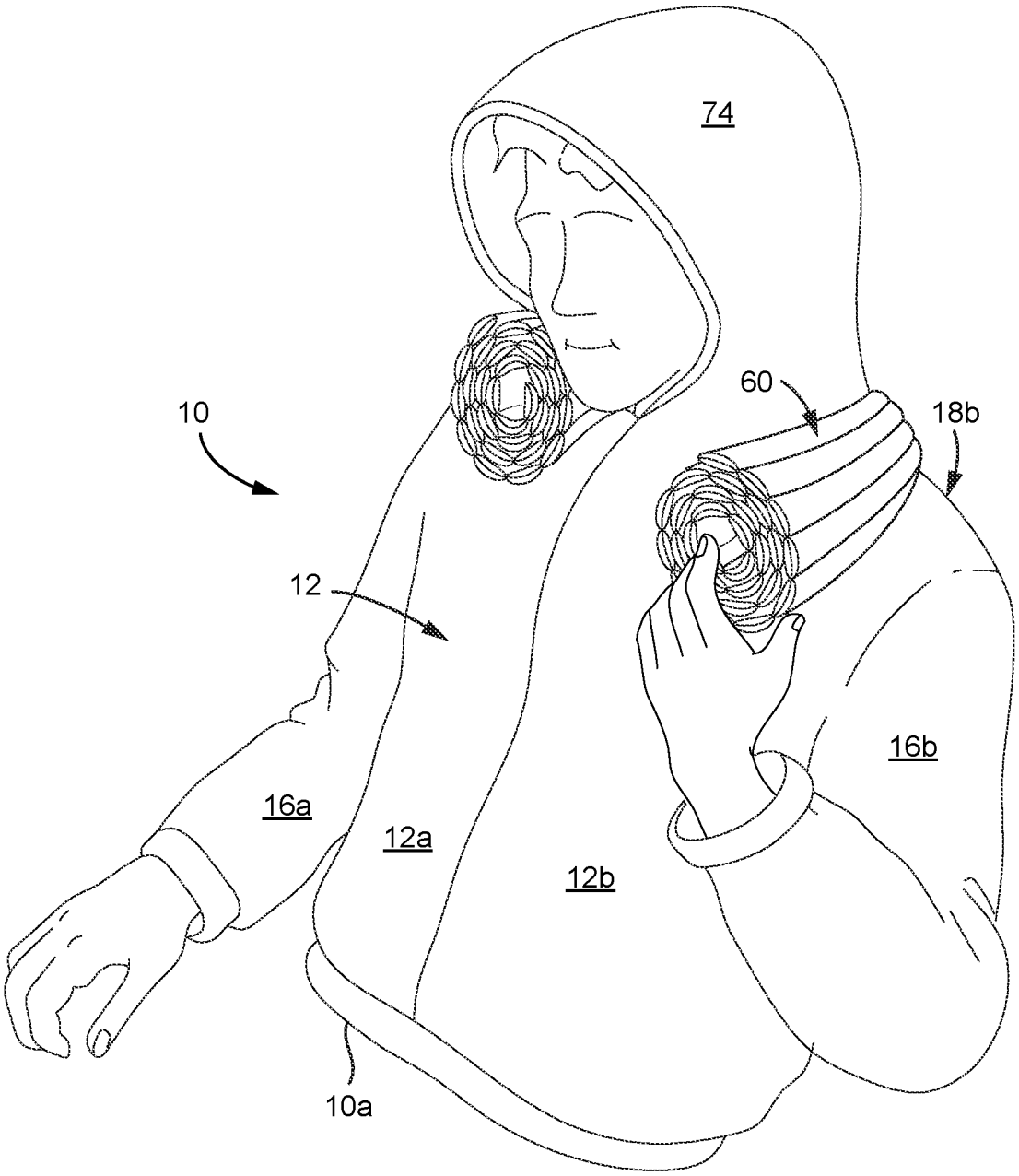
Figure 6:
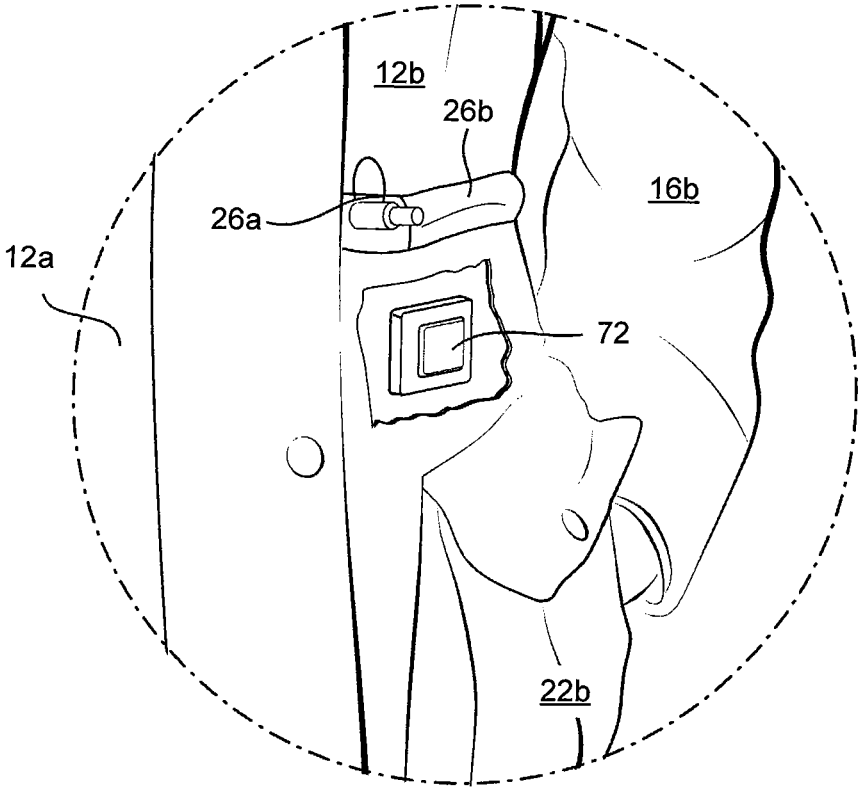

FIGS. 5A-5B sequentially show how the pull-cord mechanisms allow the passenger to roll the back cushion panel into a head/neck support pillow; and FIG. 6 is an x-ray view of a heater activation button for activating the internal jacket heating elements.

DETAILED DESCRIPTION

Figure 1:
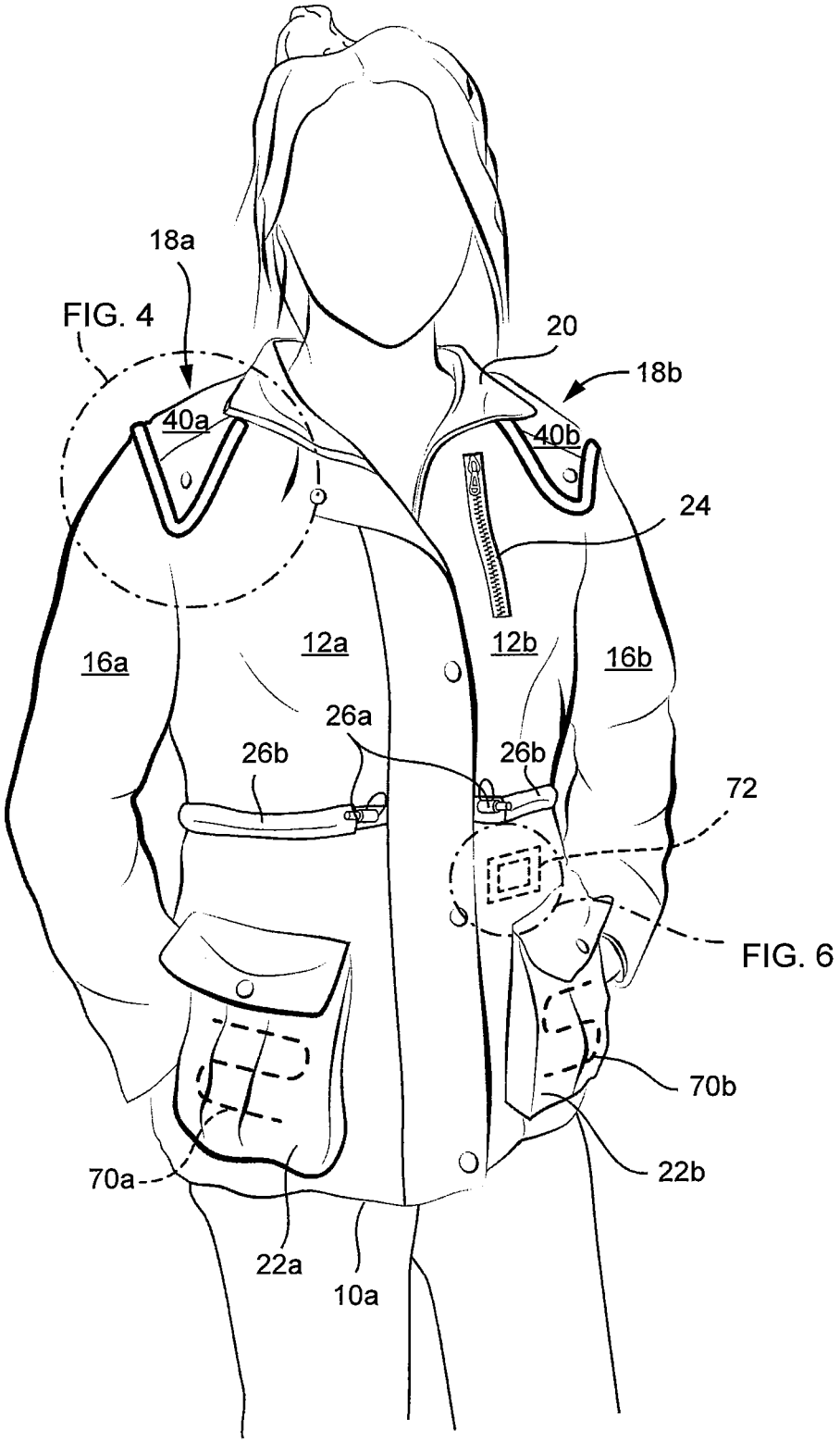
FIGS. 1 and 2 are front and back views, respectively, of a travel jacket in accordance with an embodiment of this invention being worn by a passenger.
Figure 2:
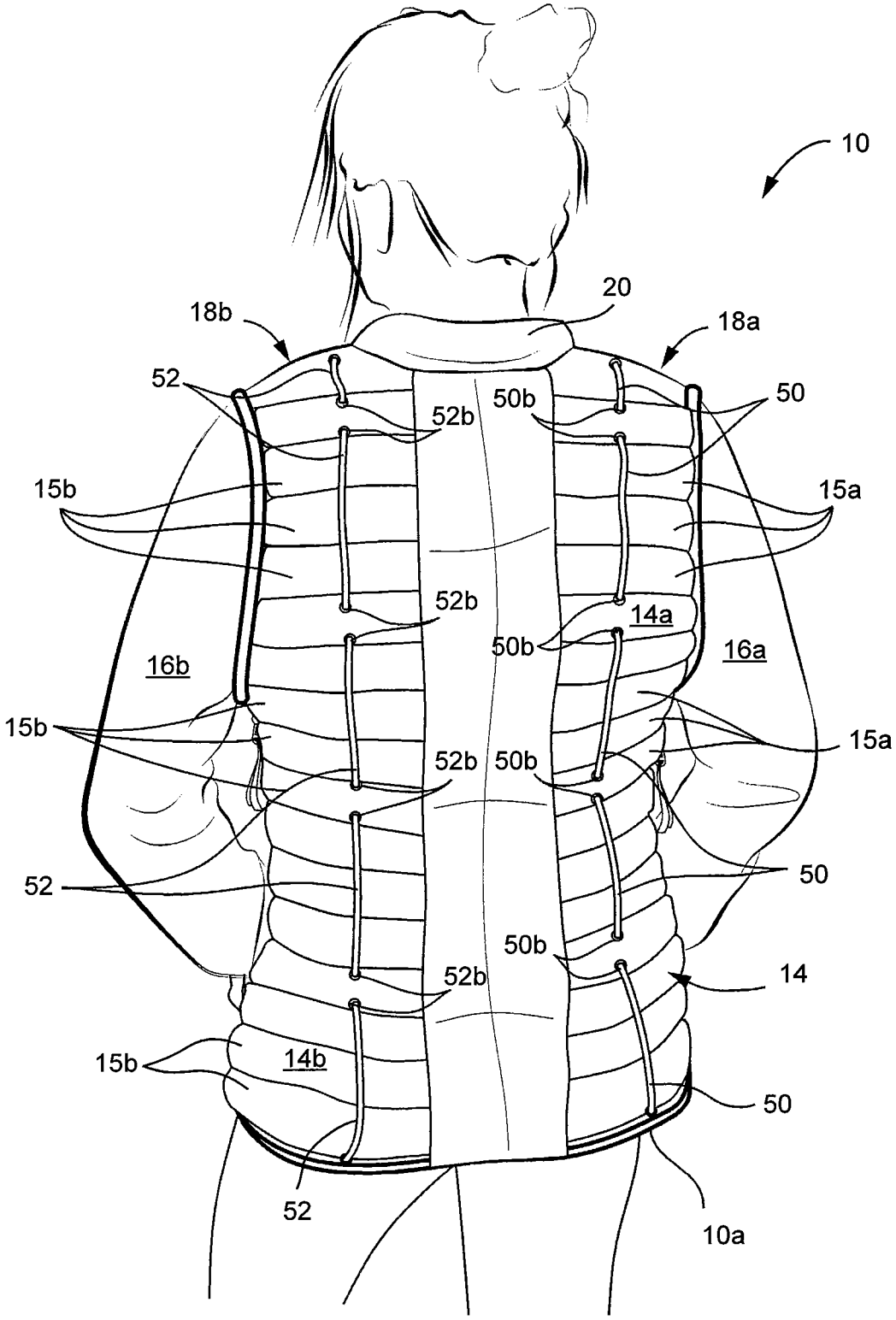

Accompanying FIGS. 1 and 2 depict a travel garment in the form of a jacket 10 in accordance with an embodiment of the invention. As shown, the jacket 10 includes a front jacket panel 12 and a back cushion panel 14 joined to one another along the jacket sides so as to envelope substantially the wearer's torso. As is conventional, the front jacket panel 12 includes a midsagittal opening between the front panel sections 12*a*, 12*b* that can be secured to one another by any fasteners conventionally employed for garment closures (e.g., cooperating snaps, button/button holes, zippers, hook-and-loop fabric fasteners and the like) so as to allow the wearer to don and doff the jacket 10 and to close the jacket front panel 12 as may be needed. The jacket is of sufficient length so as to extend at or below the wearer's waist and terminates in a lower hem 10*a*.

The jacket will also include right and left sleeves 16*a*, 16*b* extending from the right and left shoulder regions 18*a*, 18 of the jacket so as to cover the wearer's right and left arms and a collar 20 surrounding the wearer's neck. It should be mentioned however that the sleeves 16*a*, 16*b* are not critically required in which case the garment will then be in the form of a travel vest.

The jacket may have a number of externally accessible compartments, such as right and left pouch pockets 22*a*, 22*b* provided on the front panels 12*a*, 12*b*, respectively, and a zippered breast pocket 24. The breast pocket 24 is typically provided on the left front panel 12*b* as shown in FIG. 1 but may also be provided on both the right and left front panels 12*a*, 12*b* as may be desired. An adjustable draw string 26*a* may be provided within a draw string tunnel 26*b* formed of similar fabric material as the front panel 12 so as to allow a user to expand/contract the waist dimension of the jacket 10 as may be desired for fit.

Figure 3A:
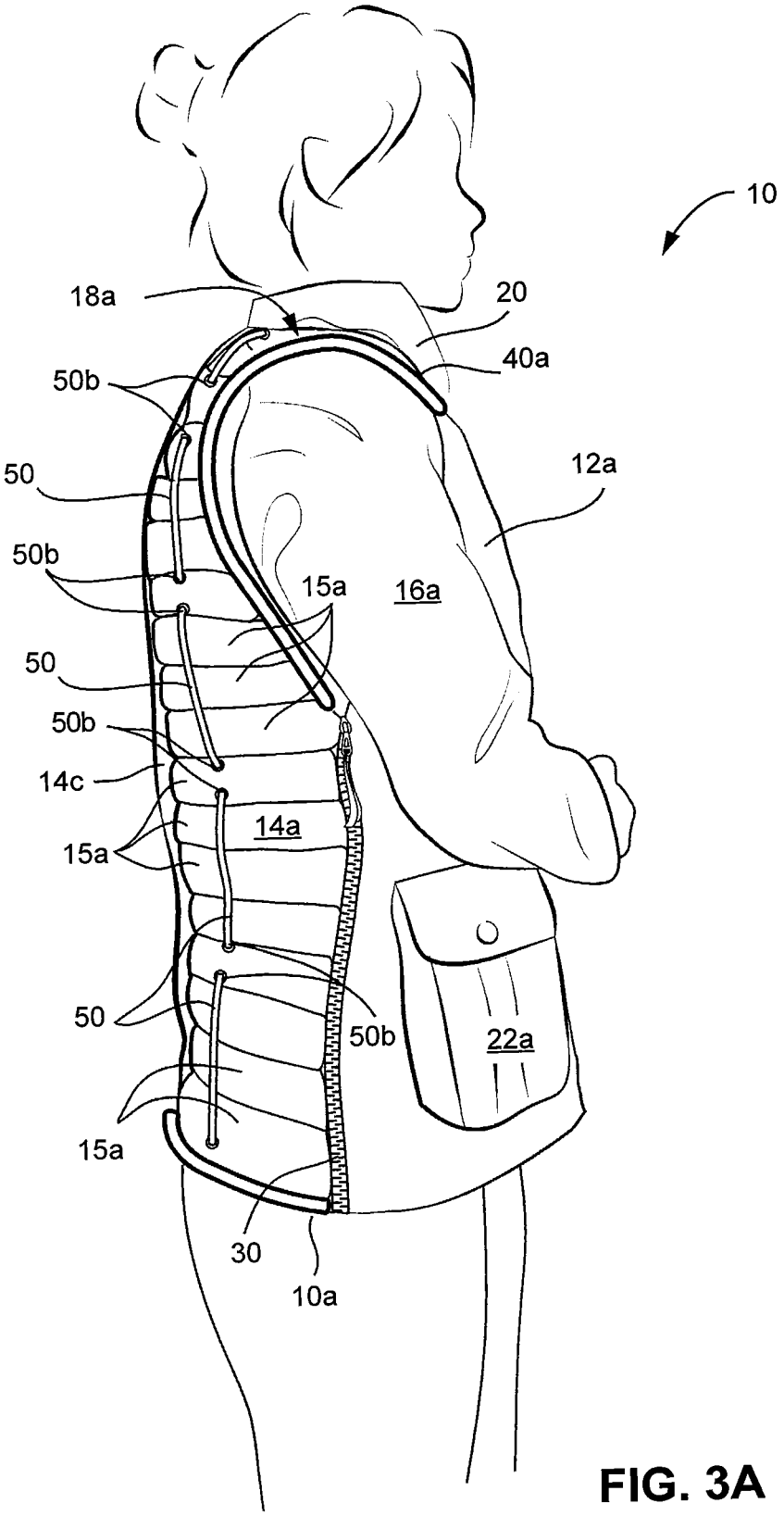
FIGS. 3A-3B are right side views of the travel jacket as depicted in FIGS. 1-2 and showing the manner in which the sides of the cushion panel may be separated from the jacket for use as a neck cushion roll.
Figure 3B:
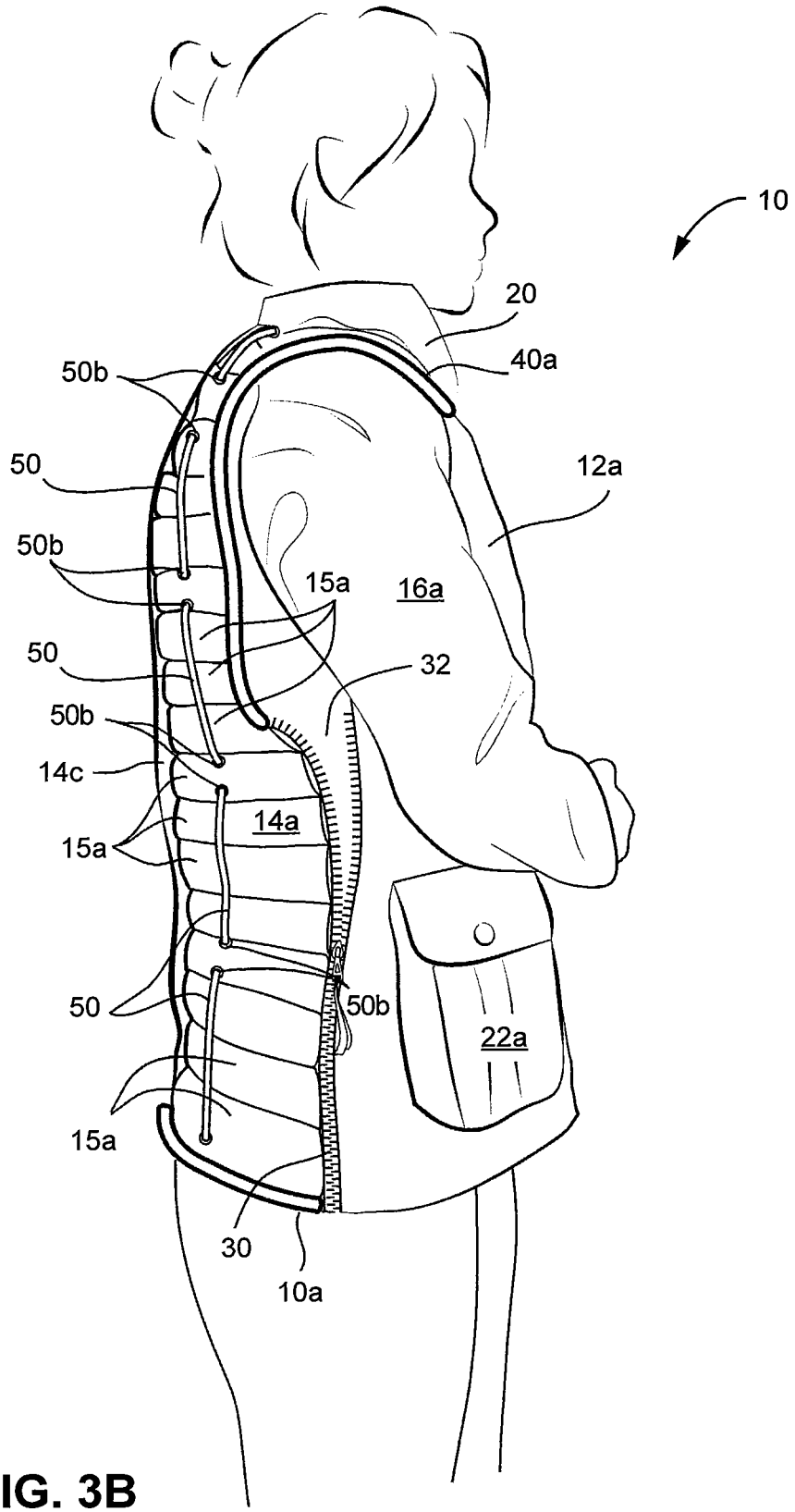

The back cushion panel 14 is removably attached to the front panel 12 along each of its lower right and left sides by a zipper 30 extending from the lower seam of the jacket 10 to the underarm region of the sleeves 16*a*, 16*b*. It will be appreciated that even though only the right side zipper 30 is depicted in FIGS. 3A and 3B, each of the lower right and left sides of the cushion panel 14 will be attached to a corresponding portion of the right and left front panels 12*a*, 12*b* by right and left side zippers 30. Other conventional two-part fabric closure elements (e.g., buttons/button holes, hook-and-loop fabric fasteners, snaps and the like) may be employed in lieu of or in addition to the zippers 30. As shown in FIG. 3B, the right side zipper 30 is partially unzipped so as to reveal an interior back panel 32 that is covered by the cushion back panel 14 when the latter is attached to the front side panels 12*a*, 12*b*, but is exposed to form the back of the jacket 10 when the cushion back panel 14 is rolled into a neck and head support pillow in the manner to be described further below.

The back cushion panel 14 may be provided with right and left channel sections 14*a*, 14*b* and a central non-channeled section 14*c* positioned centrally between each of the channel sections 14*a*, 14*b*. In the embodiment depicted, the right and left channel sections 14*a*, 14*b* are each comprised generally of generally horizontally disposed pillow channels (a representative few of which are identified in the drawings by reference numerals 15*a*, 15*b*) formed of a soft and resilient material, e.g., down-filled tubular channels. The central section 14*c* on the other hand may itself be formed of a soft and resilient fabric material of sufficient thickness to provide comfort when rolled into the head/neck supporting configuration.

Figure 4:
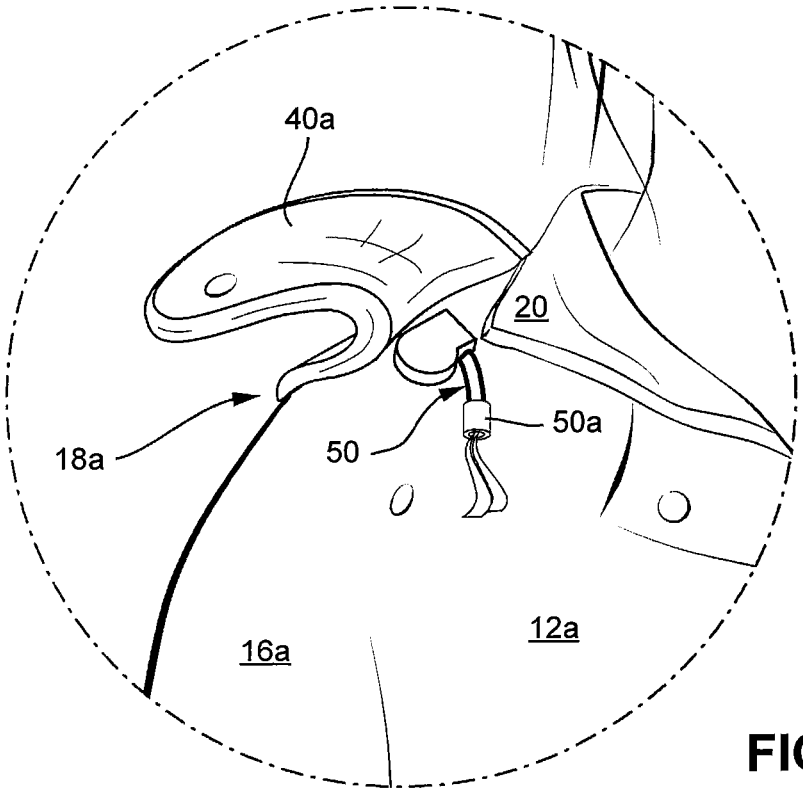
FIG. 4 is an enlarged detail view of an exemplary pull-cord mechanism that is operable interconnected to the back cushion panel.

As is shown in an exemplary manner by FIG. 4, each of the shoulder regions 18*a*, 18*b* includes shoulder patches 40*a*, 40*b* that may be positionally snapped to the front panels 12*a*, 12*b* so as to cover the terminal ends 50*a*, 52*a* of the right and left pull cords 50, 52, respectively, but then unsnapped to reveal such terminal ends 50*a*, 52*a*. The pull cords 50, 52 extend from the terminal ends 50*a*, 52*a* at the respective shoulder regions 18*a*, 18*b* and are attached to the respective cushion panels 14*a*, 14*b* at or near the lower hem 10*a* of the jacket. In this regard, the cords 50, 52 may be laced though separated eyelets 50*b*, 52*b* formed in the cushion panels 14*a*, 14*b* to thereby allow each cord 50, 52 to be drawn therethrough when a pull force is exerted on the terminal ends 50*a*, 52*a*. Although the cords 50, 52 are depicted in the Figures as being exposed, they could of course be place within appropriate fabric tunnels (not shown) so as to be visibly hidden.

Figure 5C:
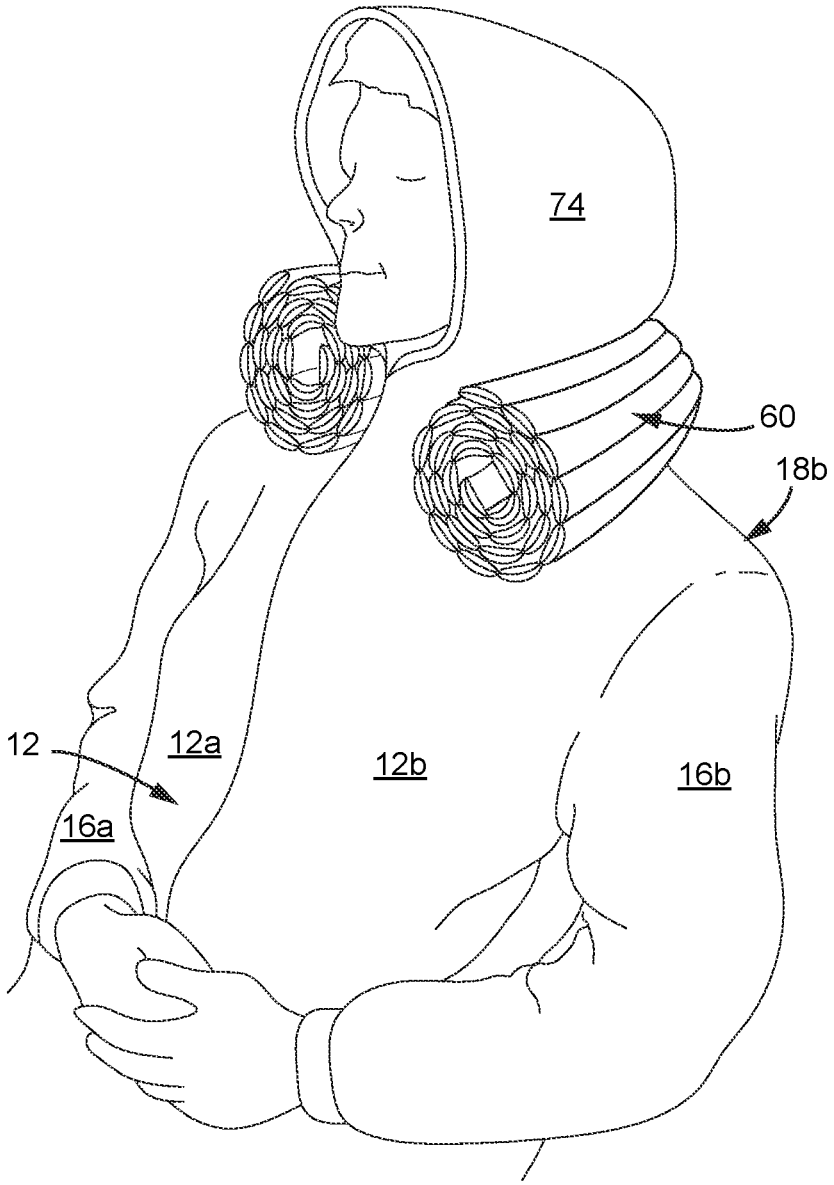

As is shown in FIGS. 5A-5C, when the wearer exerts a pull force on the terminal ends 50*a*, 52*a* of each cord 50, 52, the cords 50, 52 will cause the cushion back panel 14 to be rolled onto itself forming a cushion roll 60 that can be adjustably positioned about the wearers neck in the manner of a horseshoe shaped pillow roll. If desired, fasteners may be provided so as to positionally fasten the right and left end regions of the cushion roll 60 to the upper right and left front panels 12*a*, 12*b*, respectively. It will be appreciated that the central non-channeled region 14*c* will similarly be rolled onto itself and thereby be directly positioned at the back neck region of the wearer providing comfort at such region while the lateral ends of the cushion roll provide positional stability.

When it is desired to return the cushion roll to its original unrolled condition, the wearer need only allow the cushion roll to unroll such that the back cushion panel 14 assumes its original substantially flat condition, whereupon the lateral sides thereof may be reattached to the front panels 12*a*, 12*b* via zippers 30.

Other comfort features may also be provided in the jacket 10. For example, heating elements 70*a*, 70*b* may be embedded in the fabric forming each of the pockets 22*a*, 22*b* as schematically depicted in FIG. 1. A hidden activation switch 72 operatively connects the heating elements 70*a*, 70*b* with a source of electrical energy (e.g., rechargeable or replaceable batteries, not shown). Thus, activation of the switch 72 will allow the pockets 22*a*, 22*b* to function as hand warmers. Other heating elements could also be embedded through the various components of the jacket 10, including for example the right and left front panels 12*a*, 12*b*, right and left sleeves 16*a*, 16*b* and the interior back panel 32. A suitable controller may be associated with the switch 72 so as to deactivate the heating elements after a predetermined time has elapsed. In addition, the jacket 10 may be provided with a fixed or removable hood 74 (see FIGS. 5A-5C) that itself may be provided with heating elements in the manner described hereinabove.

While reference is made to a particular embodiment of the invention, various modifications within the skill of those in the art may be envisioned. Therefore, it is to be understood that the invention is not to be limited to the disclosed embodiment, but on the contrary, is intended to cover various modifications and equivalent arrangements included within the spirit and scope thereof.

What is claimed is:

1. An upper body garment comprising:

front and back panels adapted to enclose a torso region of a wearer, wherein the back panel includes a cushion back panel having an upper end attached to the front panel at shoulder regions of the garment and extending from the upper end to a lower end adapted to be positioned at or below a waist region of the wearer, and a pull cord assembly comprising a pull cord having one end operably connected to the lower end of the cushion back panel and an opposite free end positioned near one of the shoulder regions of the garment, wherein right and left sides of the cushion back panel are releasably attachable to corresponding right and left sides of the front panel thereby allowing the cushion back panel to assume attached and unattached configurations relative to the front panel such that a pull force exerted on the free end of the pull cord when the cushion back panel is in the unattached configuration causes the cushion back panel to roll from the lower end toward the upper end and thereby form a cushion roll configured to be disposed at a neck region of the wearer.

2. The garment according to claim 1, wherein the cushion back panel includes zippers releasably attaching the right and left sides of the cushion back panel to the corresponding right and left sides of the front panel.

3. The garment according to claim 1, wherein the cushion back panel comprises a series of eyelets between the upper and lower ends for receiving the pull cord in the series of eyelets.

4. The garment according to claim 1, wherein the garment comprises a releasable shoulder patch covering the free end of the pull cord adapted to be disposed at the shoulder region of the wearer.

5. The garment according to claim 1, wherein the front panel comprises at least one hand pocket, and wherein the garment further comprises a warming system operably associated with the at least one hand pocket.

6. The garment according to claim 5, wherein the warming system comprises a visibly hidden activation switch.

7. The garment according to claim 1, wherein the front panel comprises at least one breast pocket.

8. The garment according to claim 1, wherein the garment comprises a draw string adapted to be disposed at the waist region of the wearer to allow adjustment of a waist dimension of the garment.

9. The garment according to claim 8, further comprising a fabric draw string tunnel in which a lengthwise extent of the draw string is positioned.

10. The garment according to claim 1, wherein the cushion back panel comprises a series of substantially horizontally disposed channel sections.

11. The garment according to claim 10, wherein the series of substantially horizontally disposed channel sections comprises right and left series of substantially horizontally disposed channel sections, and a central non-channel section disposed between the right and left series of substantially horizontally disposed channel sections.

12. The garment according to claim 11, wherein at least one of the right and left series of channel sections comprises a series of eyelets between the upper and lower ends for receiving the pull cord in the series of eyelets.

13. The garment according to claim 1, further comprising a second pull cord assembly, the second pull cord assembly having a pull cord which includes one end operably connected to the lower end of the cushion back panel and an opposite free end positioned near the other one of the shoulder regions of the garment.

14. The garment according to claim 13, wherein the cushion back panel comprises a laterally separated series of eyelets between the upper and lower ends for receiving a respective one of the pull cords in the laterally separated series of eyelets.

15. The garment according to claim 14, wherein the garment comprises a pair of releasable shoulder patches, each of the releasable shoulder patches adapted to cover a respective one of the free ends of the pull cords and adapted to be disposed at a respective shoulder region of the wearer.

16. The garment according to claim 13, wherein the front panel comprises at least one hand pocket, and wherein the garment further comprises a warming system operably associated with the at least one hand pocket.

17. The garment according to claim 16, wherein the warming system comprises a visibly hidden activation switch.

18. The garment according to claim 13, wherein the front panel comprises at least one breast pocket.

19. The garment according to claim 13, wherein the garment comprises a draw string adapted to be disposed at the waist region of the wearer to allow adjustment of a waist dimension of the garment.

20. The garment according to claim 13, wherein the cushion back panel comprises a series of substantially horizontally disposed channel sections.

21. The garment according to claim 13, wherein the cushion back panel comprises right and left series of substantially horizontally disposed channel sections, and a central non-channel section disposed between the right and left series of channel sections.

22. The garment according to claim 21, wherein each of the right and left series of channel sections comprises a series of eyelets between the upper and lower ends for receiving a respective pull cord in the series of eyelets.

23. The garment according to claim 1, wherein the garment is a jacket or a vest.

* * * * *